US009988847B2

(12) United States Patent
Purohit et al.

(10) Patent No.: US 9,988,847 B2
(45) Date of Patent: Jun. 5, 2018

(54) DOWNHOLE MUD MOTOR WITH ADJUSTABLE BEND ANGLE

(71) Applicant: Halliburton Energy Services, Inc., Houston, TX (US)

(72) Inventors: Ankit Purohit, Barnagar (IN); Rahul Ramchandra Gaikwad, Solapur (IN); Ratish Suhas Kadam, Pune (IN); Bhargav Gajji, Pune (IN)

(73) Assignee: Halliburton Energy Services, Inc., Houston, TX (US)

( * ) Notice: Subject to any disclaimer, the term of this patent is extended or adjusted under 35 U.S.C. 154(b) by 123 days.

(21) Appl. No.: 15/022,509

(22) PCT Filed: Oct. 16, 2013

(86) PCT No.: PCT/US2013/065258
§ 371 (c)(1),
(2) Date: Mar. 16, 2016

(87) PCT Pub. No.: WO2015/057217
PCT Pub. Date: Apr. 23, 2015

(65) Prior Publication Data

US 2016/0230466 A1 Aug. 11, 2016

(51) Int. Cl.

| | |
|---|---|
| ***E21B 4/02*** | (2006.01) |
| ***E21B 7/06*** | (2006.01) |
| ***E21B 3/00*** | (2006.01) |

(52) U.S. Cl.
CPC ..... *E21B 7/068* (2013.01); *E21B 3/00* (2013.01); *E21B 4/02* (2013.01); *E21B 7/067* (2013.01)

(58) Field of Classification Search
CPC ... E21B 7/068; E21B 3/00; E21B 4/02; E21B 7/067
See application file for complete search history.

(56) References Cited

U.S. PATENT DOCUMENTS

| | | | | |
|---|---|---|---|---|
| 4,067,404 | A | 1/1978 | Crase | |
| 5,050,692 | A * | 9/1991 | Beimgraben | E21B 7/067 175/256 |
| 5,899,281 | A | 5/1999 | von Gynz-Rekowski | |

(Continued)

FOREIGN PATENT DOCUMENTS

| | | |
|---|---|---|
| EP | 0497421 A1 | 8/1992 |
| EP | 0774563 A2 | 5/1997 |

(Continued)

OTHER PUBLICATIONS

International Search Report and Written Opinion issued in related PCT/US2013/065258 dated Jul. 17, 2014, 12 pages.

*Primary Examiner* — Brad Harcourt
(74) *Attorney, Agent, or Firm* — Alan Bryson; Baker Botts L.L.P.

(57) ABSTRACT

An example downhole motor may include a first housing and a second housing coupled to the first housing at a movable joint. A turbine may be within the first housing in selective fluid communication with a bore of the first housing. A biasing mechanism may be coupled to the movable joint and the turbine. The biasing mechanism may alter an angle between a first longitudinal axis of the first housing and a second longitudinal axis of the second housing by altering an orientation of the movable joint.

14 Claims, 4 Drawing Sheets

(56) References Cited

U.S. PATENT DOCUMENTS

| | | | | |
|---|---|---|---|---|
| 6,092,610 | A | 7/2000 | Kosmala et al. | |
| 6,554,083 | B1 | 4/2003 | Kerstetter | |
| 6,659,201 | B2 | 12/2003 | Head et al. | |
| RE39,970 | E | 1/2008 | Askew | |
| 7,882,904 | B2 | 2/2011 | von Gynz-Rekowski et al. | |
| 8,297,375 | B2 | 10/2012 | Hall et al. | |
| 2002/0007969 | A1 | 1/2002 | Head et al. | |
| 2003/0010534 | A1* | 1/2003 | Chen | E21B 7/067 175/61 |
| 2003/0094310 | A1 | 5/2003 | Eppink et al. | |
| 2007/0151767 | A1* | 7/2007 | Downton | E21B 7/067 175/73 |
| 2014/0209389 | A1* | 7/2014 | Sugiura | E21B 7/067 175/73 |

FOREIGN PATENT DOCUMENTS

| | | | |
|---|---|---|---|
| EP | 1106777 | A1 | 6/2001 |
| EP | 1258593 | A2 | 11/2002 |
| GB | 2271795 | A | 4/1994 |
| GB | 2363811 | A | 1/2002 |
| GB | 2373272 | A | 9/2002 |
| WO | 98-53175 | A1 | 11/1998 |
| WO | 2004-097160 | A2 | 11/2004 |
| WO | 2012-158144 | A1 | 11/2012 |

* cited by examiner

DOWNHOLE MUD MOTOR WITH ADJUSTABLE BEND ANGLE

CROSS-REFERENCE TO RELATED APPLICATION

The present application is a U.S. National Stage Application of International Application No. PCT/US2013/065258 filed Oct. 16, 2013, which is incorporated herein by reference in its entirety for all purposes.

BACKGROUND

The present disclosure relates generally to well drilling operations and, more particularly, to a downhole mud motor with an adjustable bend angle.

As well drilling operations become more complex, and hydrocarbon reservoirs more difficult to reach, the need to precisely locate a drilling assembly—vertically and horizontally—in a formation increases. Part of this operation requires controlling a direction in which the drilling assembly/drill bit is pointed, either to avoid particular formations or to intersect formations of interest. Current mechanisms for controlling the direction of the drilling assembly/drill bit are typically complex and difficult to implement, or require the drill string be removed from the borehole, increasing drilling time and expense.

FIGURES

Some specific exemplary embodiments of the disclosure may be understood by referring, in part, to the following description and the accompanying drawings.

Figure 4A:
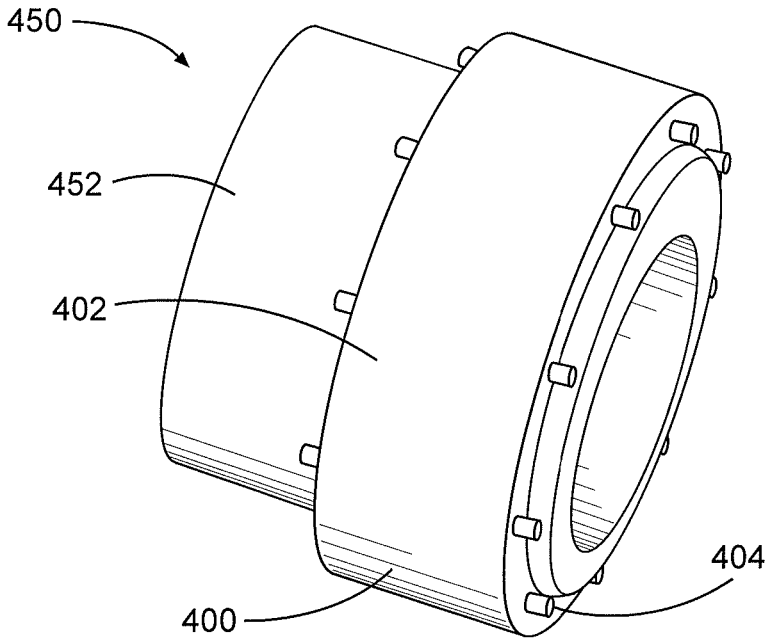
Figure 4B:
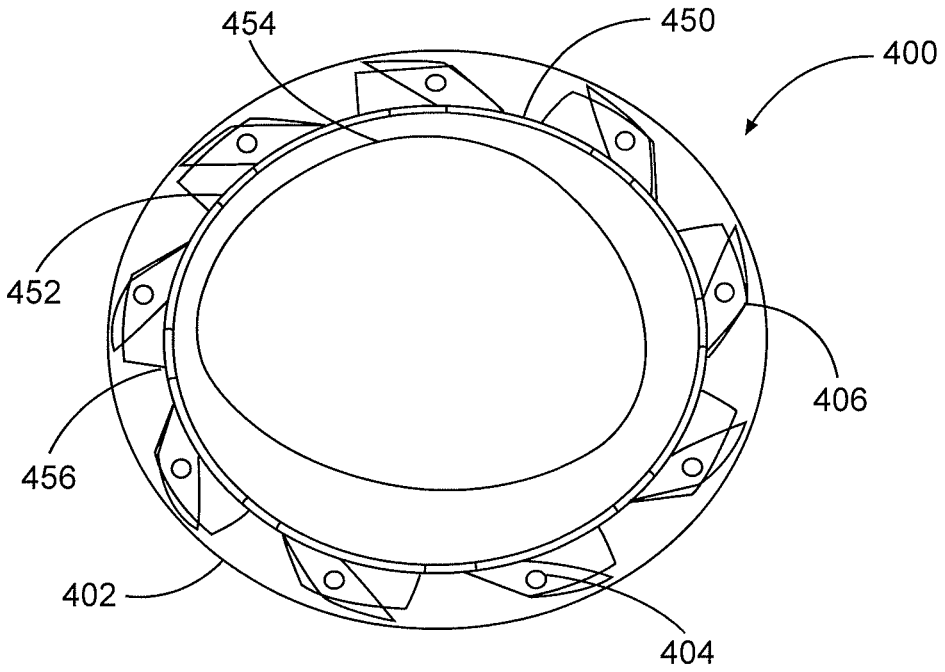

FIGS. 4A-B are diagrams of an example locking mechanism for a downhole motor, according to aspects of the present disclosure.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components. It may also include one or more interface units capable of transmitting one or more signals to a controller, actuator, or like device.

For the purposes of this disclosure, computer-readable media may include any instrumentality or aggregation of instrumentalities that may retain data and/or instructions for a period of time. Computer-readable media may include, for example, without limitation, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such wires, optical fibers, microwaves, radio waves, and other electromagnetic and/or optical carriers; and/or any combination of the foregoing.

Illustrative embodiments of the present disclosure are described in detail herein. In the interest of clarity, not all features of an actual implementation may be described in this specification. It will of course be appreciated that in the development of any such actual embodiment, numerous implementation-specific decisions are made to achieve the specific implementation goals, which will vary from one implementation to another. Moreover, it will be appreciated that such a development effort might be complex and time-consuming, but would nevertheless be a routine undertaking for those of ordinary skill in the art having the benefit of the present disclosure.

To facilitate a better understanding of the present disclosure, the following examples of certain embodiments are given. In no way should the following examples be read to limit, or define, the scope of the disclosure. Embodiments of the present disclosure may be applicable to horizontal, vertical, deviated, or otherwise nonlinear wellbores in any type of subterranean formation. Embodiments may be applicable to injection wells as well as production wells, including hydrocarbon wells. Embodiments may be implemented using a tool that is made suitable for testing, retrieval and sampling along sections of the formation. Embodiments may be implemented with tools that, for example, may be conveyed through a flow passage in tubular string or using a wireline, slickline, coiled tubing, downhole robot or the like.

The terms "couple" or "couples" as used herein are intended to mean either an indirect or a direct connection. Thus, if a first device couples to a second device, that connection may be through a direct connection or through an indirect mechanical or electrical connection via other devices and connections. Similarly, the term "communicatively coupled" as used herein is intended to mean either a direct or an indirect communication connection. Such connection may be a wired or wireless connection such as, for example, Ethernet or LAN. Such wired and wireless connections are well known to those of ordinary skill in the art and will therefore not be discussed in detail herein. Thus, if a first device communicatively couples to a second device, that connection may be through a direct connection, or through an indirect communication connection via other devices and connections.

Modern petroleum drilling and production operations demand information relating to parameters and conditions downhole. Several methods exist for downhole information collection, including logging-while-drilling ("LWD") and measurement-while-drilling ("MWD"). In LWD, data is typically collected during the drilling process, thereby avoiding any need to remove the drilling assembly to insert a wireline logging tool. LWD consequently allows, the driller to make accurate real-time modifications or corrections to optimize performance while minimizing down time. MWD is the term for measuring conditions downhole concerning the movement and location of the drilling assembly while the drilling continues. LWD concentrates more on formation parameter measurement. While distinctions between MWD and LWD may exist, the terms MWD and LWD often are used interchangeably. For the purposes of this disclosure, the term LWD will be used with the understanding that this term encompasses both the collection of formation parameters and the collection of information relating to the movement and position of the drilling assembly.

Figure 1:
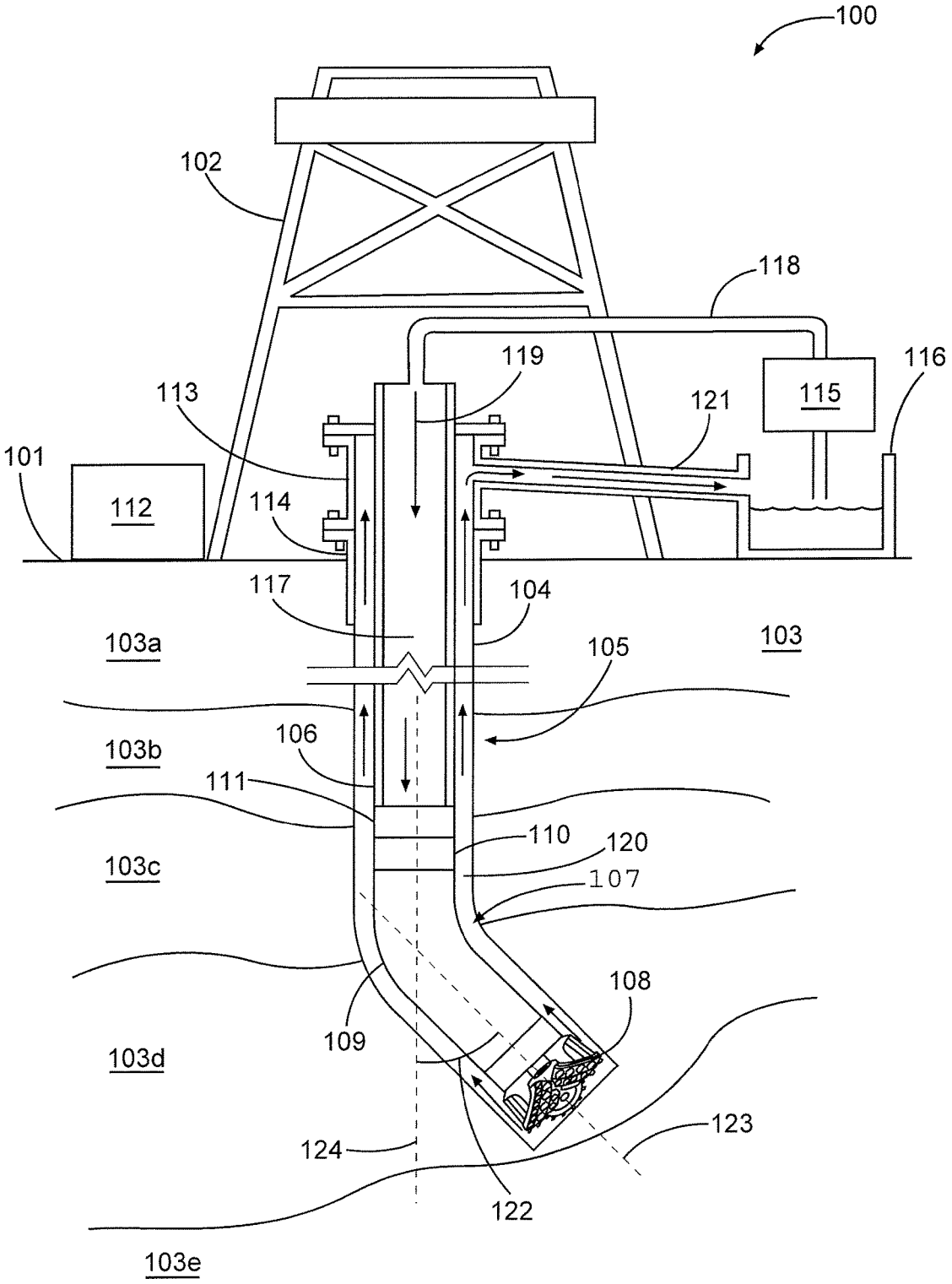
FIG. 1 is a diagram of an example drilling system, according to aspects of the present disclosure.

FIG. 1 is a diagram illustrating an example drilling system 100, according to aspects of the present disclosure. The drilling system 100 includes rig 102 mounted at the surface 101 and positioned above borehole 104 within a subterranean formation 103. The formation 103 may be comprised of at least one rock strata. In the embodiment shown, the formation 103 is comprised of rock strata 103*a-e*, each of which may be made of different rock types with different characteristics. At least one of the rock strata 103*a-e* may contain hydrocarbon and may be a "target" formation to which the borehole 104 is being directed.

In the embodiment shown, a drilling assembly 105 may be positioned within the borehole 104 and may be coupled to the rig 102. The drilling assembly 105 may comprise drill string 106 and bottom hole assembly (BHA) 107. The drill string 106 may comprise a plurality of segments threadedly connected. The BHA 107 may comprise a drill bit 108, a downhole motor 109, a measurement-while-drilling/logging while drilling (MWD/LWD) apparatus 110, and a telemetry system 111. The MWD/LWD apparatus 110 may comprise multiple sensors through which measurements of the formation 103 may be taken and may be coupled to the drill string 106 through the telemetry system 111. The downhole motor 109 may be coupled to the drill bit 108 and to the drill string 106 through the MWD/LWD apparatus 110 and the telemetry system 111.

In certain embodiments, the drilling system 100 may further comprise a control unit 112 positioned at the surface 101. The control unit 112 may comprise an information handling system that may communicate with the BHA 107 through the telemetry system 111. In certain embodiments, one or more signals may be communicated between the telemetry system 111 and the control unit 112 via mud pulses, wireless communications channels, or wired communications channels. The telemetry system 111 may be communicably coupled to at least one element of the BHA 107, including the downhole motor 109 and the MWD/LWD apparatus 110. Signals transmitted from the control unit 112 to one of the downhole motor 109 and the MWD/LWD apparatus 110 may be received at the telemetry system 111, decoded at a processor or controller of the telemetry system 111, and transmitted within the BHA 107. The signals may be intended to alter the operation or state of one of the downhole motor 109 and the MWD/LWD apparatus 110. For example, a signal may be intended to cause the MWD/LWD apparatus 110 to take measurements within at a certain frequency, or to alter a speed of the downhole motor 109.

The drill string 106 may extend downward through a surface tubular 113 into the borehole 104. The surface tubular 113 may be coupled to a wellhead 114. The wellhead 114 may include a portion that extends into the borehole 104. In certain embodiments, the wellhead 114 may be secured within the borehole 104 using cement, and may work with the surface tubular 108 and other surface equipment, such as a blowout preventer (BOP) (not shown), to prevent excess pressures from the formation 103 and borehole 104 from being released at the surface 101.

During drilling operations, a pump 115 located at the surface 101 may pump drilling fluid from a fluid reservoir 116 into an inner bore 117 of the drill string 106. The pump 115 may be in fluid communication with the inner bore 117 through at least one fluid conduit or pipe 118 between the pump 115 and drill string 106. As indicated by arrows 119, the drilling fluid may flow through the interior bore 117 of drill string 106, the BHA 107, and the drill bit 108 and into a borehole annulus 120. The borehole annulus 120 is created by the rotation of the drill bit 108 in borehole 104 and is defined as the space between the interior/inner wall or diameter of borehole 104 and the exterior/outer surface or diameter of the drill string 106. The annular space may extend out of the borehole 104, through the wellhead 114 and into the surface tubular 113. Fluid pumped into the borehole annulus 120 through the drill string 106 may flow upwardly, exit the borehole annulus 120 into the surface tubular 113, and travel to the surface reservoir 116 through a fluid conduit 121 coupled to the surface tubular 113 and the surface reservoir 116.

The downhole motor 109 may be coupled to and rotate the drill bit 108. As opposed to a conventional drilling assembly where rotation is imparted to the drill bit 108 from the surface 101 through the drill string 106, the drilling system 101 may primarily drive the drill bit 108 using the downhole motor 109. In certain embodiments, the downhole motor 109 may comprise a mud motor that is driven by the circulation of drilling fluid through the drill string 106. The downhole motor 109 may convert the fluid flow into torque that is then transmitted to the drill bit 108. When the drill bit 108 rotates, it may engage with the formation 103, and extend the borehole 104. The speed with which the downhole motor 109 drives the drill bit 108 may be based, at least in part, on the flow rate of the drilling fluid through the downhole motor 109. Other types of downhole motors are possible, including, but not limited to, electric motors.

In certain drilling applications, it may be necessary to direct the drill bit 108 or drilling assembly 105 toward a target formation 103*e*, which may contain hydrocarbons. Directing the drill bit 108 may comprise controlling an inclination of the drill bit 108, which may be characterized as the angle between a longitudinal axis 123 of the drill bit 108 and a reference plane, such as the surface 101, a plane perpendicular to the surface 101, a boundary between to formation strata 103*a*-103*e*, or another plane that would be appreciated by one of ordinary skill in the art in view of this disclosure. Establishing and maintaining the correct inclination can be difficult, however, given the sometimes extreme downhole operating conditions and the uncertainty regarding the locations and orientations of formation strata 103*a-e*.

According to aspects of the present disclosure, the downhole motor 109 may comprise a bend angle 122 that is adjustable while the downhole motor 109 is positioned downhole. In the embodiment shown, the bend angle 122 comprises the angle between the longitudinal axis 123 of the drill bit 108 and a bottom portion of the downhole motor 109, and the longitudinal axis 124 of the drill string 106 and an upper portion of the downhole motor 109. Adjusting the bend angle 122 alters the longitudinal axis 123 of the drill bit 108 with respect to the drill string 106, which functions to alter the inclination of the drill bit 108. Because the bend angle 122 of the downhole motor 109 can be adjusted downhole, the inclination of the drill bit 108 may be modified in real-time or near real-time in response to downhole measurements taken by the MWD/LWD apparatus 110, improving drilling accuracy and reducing drilling time.

Figure 2:
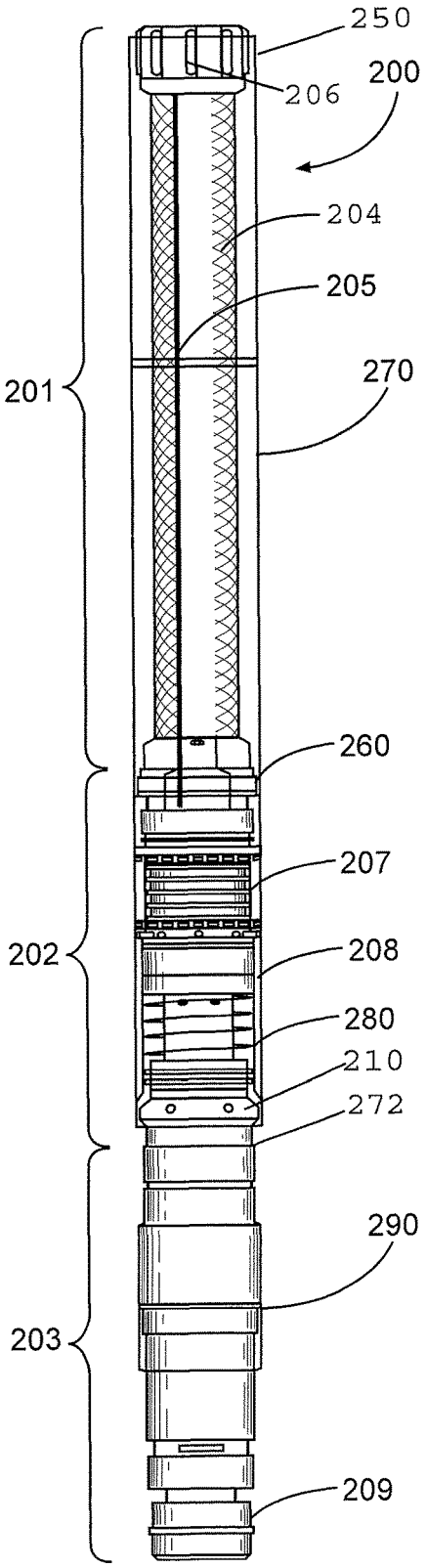
FIG. 2 is a diagram of an example downhole motor with an adjustable bend angle, according to aspects of the present disclosure.

FIG. 2 is a diagram of an example downhole motor 200 with an adjustable bend angle, according to aspects of the present disclosure. The downhole motor 200 may comprise a power assembly 201, a drive assembly 202, and a bearing assembly 203. Each of the assemblies 201-203 may comprise separate housings 270, 280, and 290, respectively, that are coupled together, such as through threaded connections. In certain embodiments, the housing 270 may be coupled directly or indirectly to a drill string at an interface 250, the housing 270 may be coupled to the housing 280 at interface 260, the housing 280 may be coupled to the housing 290 at a movable joint 272, and the housing 290 may be coupled to a drill bit via a bit shaft 209 at least partially within the housing 290. The moveable joint 272 may comprise a constant-velocity (CV) joint assembly that will be described below. The housings 270 and 280 may share a substantially similar rotational position and longitudinal axis as the drill string to which they are coupled. The housing 290 of the bearing assembly 203, in contrast, may have a substantially similar rotational position as the housings 270 and 280 but a different longitudinal axis. In certain embodiments, some or all of the assemblies 201-203 and housings 270-290 may be integrated. The angle between the longitudinal axis of the housing 290 and the longitudinal axis of the housings 270 and 280 may comprise a bend angle of the downhole tool 200.

In the embodiment shown, the power assembly 201 may comprise a rotor 204 that rotates and generates torque in response to a drilling fluid flowing through it. As will be described below, this rotation and torque may be transmitted to a drive shaft at least partially disposed within the drive assembly 202. The power assembly 201 may further comprise a power source 206, such as a battery, that may be electrically coupled to the drive assembly 202. In the embodiment shown, the power source 206 is electrically coupled to the drive assembly 202 through a wire 205 disposed within the housing 270 outside of the rotor 204. The wire 205 may carry power from the power source 206 to electrical components within the drive assembly 202, described below. The wire 205 may further transmit control signals to the electrical components, the control signals, for example, being transmitted through the wire 205 by a telemetry system after originating at a surface control unit.

The drive assembly 202 may receive the torque and rotation from the rotor 204 and transmit the torque and rotation to the bearing assembly 203. According to aspects of the present disclosure, the drive assembly 202 may include one or more elements that alter a longitudinal axis of the bearing assembly 203. For example, the drive assembly 202 may comprise a biasing mechanism 208 that may control the longitudinal axis of the bearing assembly 203. A turbine 207 within the shaft assembly 202 may rotate the biasing mechanism 208 to alter the longitudinal axis of the bearing assembly 203. The drive assembly 202 further may comprise a CV joint assembly 210 that functions as the bend point about which the longitudinal axis of the bearing assembly 203 is altered.

The bearing assembly 203 may comprise the bit shaft 209 that is driven by the drive shaft within the CV shaft assembly 203, as will be described below. The bit shaft 209 may rotate within the housing 290, while the housing 290 remains substantially rotationally stable with respect to the housings 270 and 280. A drill bit (not shown) coupled to the bit shaft 209 may be rotated at substantially the same speed as the bit shaft 209.

Figure 3:
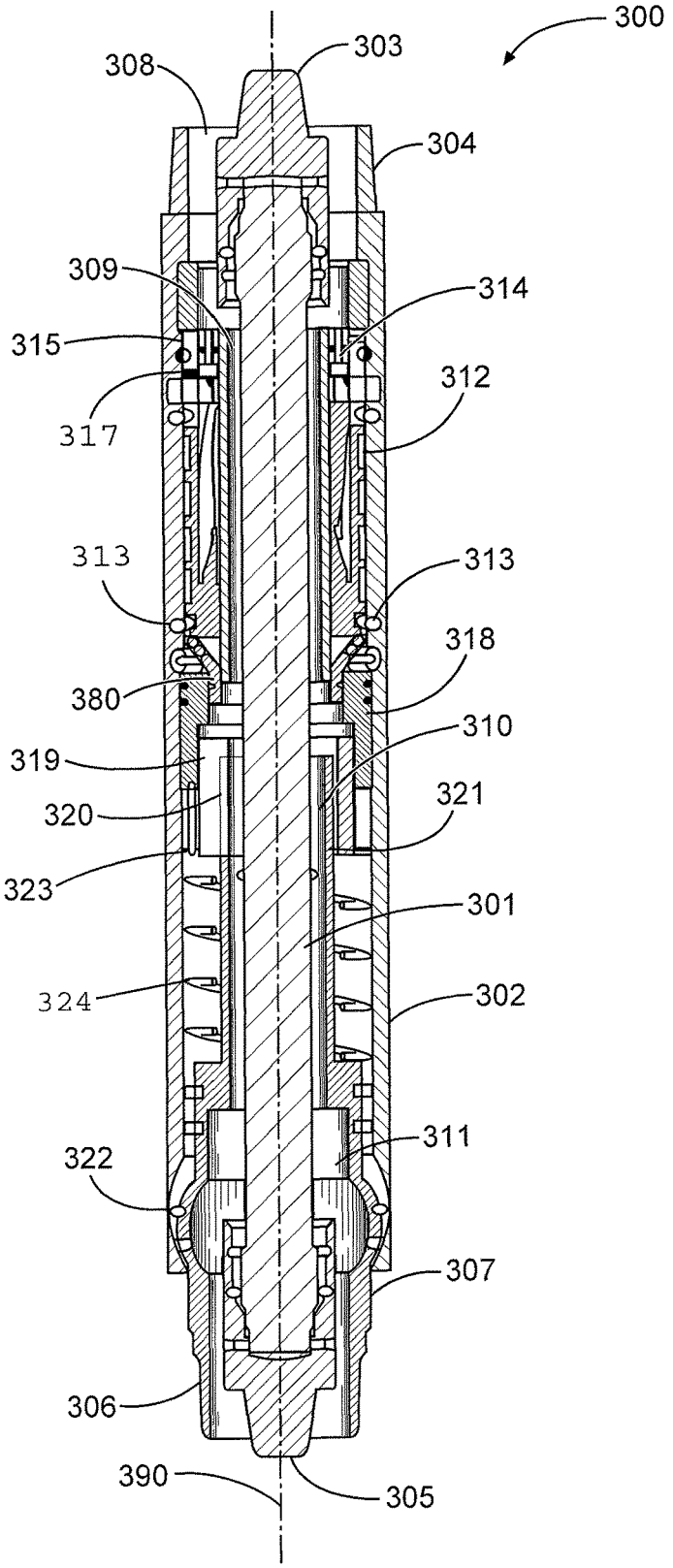
FIG. 3 is a diagram of a portion of an example downhole motor, according to aspects of the present disclosure.

FIG. 3 is a diagram of a portion of an example downhole motor, according to aspects of the present disclosure. The portion includes a drive assembly 300 the may comprise a flexible driveshaft 301 at least partially disposed within an outer housing 302. Disposed on an end of the driveshaft 301 may be a connection element 303, which may receive torque and rotation from a power assembly (not shown) coupled to the drive assembly 300 at a threaded profile 304 on the housing 302. Disposed on another end of the driveshaft 301 may be a connection element 305, which may transmit torque and rotation to a bit shaft within a bearing assembly (not shown) coupled to the drive assembly 300 at a threaded profile 306 of a CV-joint assembly 307 at least partially disposed within the housing 302.

The drive assembly 300 may be in fluid communication with drilling fluid that is pumped downhole. In the embodiment shown, drilling fluid may be received within a bore 308 of the housing 302. The bore 308 may be at least partially defined by first flow channel 309 and second flow channel 310 surrounding the drive shaft 301, and an annulus 311. The drilling fluid may exit the CV-joint assembly 307 where it may flow through a bit shaft and an attached drill bit (not shown) into the borehole.

In certain embodiments, the drive assembly 300 may comprise a turbine 312 at least partially within the housing 302. Bearings 313 disposed between the turbine 312 and the housing 302 allow the turbine 312 to rotate freely within the housing 302. The turbine 312 may be in selective fluid communication with the flow of drilling fluid through the drive assembly 300. Selective communication may be provided by a variety of mechanisms, including, but not limited to, controllable valves.

In the embodiment shown, the drive assembly 300 comprises solenoid valves 314 in a valve manifold 315 disposed between the bore 308 and the turbine 312. The solenoid valves 314 may provide selective fluid communication between the bore 308 and turbine 312 by opening to allow fluid to enter the turbine 312. The valve manifold 315 may further comprise a sensor 317 that measures the speed in rotations per minute (RPM) of the turbine 312. An example sensor 317 includes a magnetic sensor that records each time a magnetic element on the turbine 312 rotates past the sensor 317.

In certain embodiments, the valves 314 may be electrically connected to a downhole power source, which may provide necessary power for the valves 314 to actuate. An example downhole power source may comprise a power source in a power assembly (not shown), similar to the power source and power assembly described in FIG. 2. The valves 314 may further be communicably coupled to a control unit that may transmit signals to the valves 314 to cause the valves 314 to open, close, or change the size of the opening to alter the flow rate. Likewise, drive assembly 300 may transmit measurements, such as the turbine RPM, to the control unit. In certain embodiments, the drive assembly 300 may include at least one processor or controller (not shown) to either function as a control unit, or to manage communication with a control unit located elsewhere. In an exemplary embodiment, power and communication may be provided through a wire in a connected power assembly similar to the one described in FIG. 2.

The drive assembly 300 may further comprise a gear box 318. The gearbox 318 may be coupled to and receive torque and rotation from the turbine 312 through a turbine extension 380 at least partially disposed within the gear box 318. The gearbox 318 further may be coupled to and transmit torque and rotation from the turbine 312 to a biasing mechanism 319. In certain embodiments, the gearbox 318 may act as a speed reducer. The turbine 312 may drive an input of the gearbox 318 at a rate of between 1000-1800 RPM when exposed to flowing drilling fluid, with the rate of rotation output by the gearbox 318 to the biasing mechanism 319 less that 1000-1800 RPM. The difference between the input rate and the output rate is governed by the speed reduction ratio of the gearbox 318, an example of which is 180:1.

The biasing mechanism 319 may be at least partially positioned around the drive shaft 301 within the housing 302 and coupled to the turbine 312 through the gearbox 318. In the embodiment shown, the biasing mechanism 319 comprises a rotatable cam with an eccentric inner bore 320. The biasing mechanism 319 may be rotated by the gearbox 318 to set or alter a longitudinal axis of the CV-joint assembly 307. The CV-joint assembly 307 may comprise a CV-joint 322 and a shaft 321 at least partially within the eccentric inner bore 320. The position of the shaft 321 and CV-joint assembly 307 relative to a longitudinal axis 390 of the housing 302 may depend on the position of the eccentric inner bore 320. Because the CV-joint assembly 307 is aligned with the axis 390 at the CV-joint 322, any offset in the position of the shaft 321 relative to axis 390 causes the longitudinal axis of the CV-joint assembly 307 to differ from axis 390. Accordingly, any change in the position of shaft 321 by rotation of the cam causes a change in the longitudinal axis of the CV-joint assembly 307.

In certain embodiments, a locking mechanism 323 may be used to maintain the longitudinal axis of the CV-joint assembly 307. In the embodiment shown, the locking mechanism 323 may be disposed around the biasing mechanism 319 and rotationally stationary with respect to the housing 302. The locking mechanism 323 may impart a locking force to the biasing mechanism 319, causing the biasing mechanism 319 to maintain its rotational position unless sufficient torque is applied to the biasing mechanism 319 to overcome the locking force. By preventing rotation in the biasing mechanism 319, the longitudinal axis of the CV-joint assembly 307 may be maintained. As will be appreciated by one of ordinary skill in the art in view of this disclosure, the locking mechanism 323 and locking force may be configured such torque on a drill bit during a drilling operation is insufficient to overcome the locking force, yet the torque generated by the turbine 312 and gearbox 318 will cause the biasing mechanism 319 to rotate.

The drive assembly 300 may further comprise a spring 324 around the CV-joint assembly 307 within the housing 302. In the embodiment shown, the spring 324 may exert an axial force on the biasing assembly 319 and locking mechanism 323. The axial force may ensure that both the biasing assembly 319 and locking mechanism 323 stay in position with respect to the gearbox 318, while allowing some movement to compensate for spikes in torque caused by a drilling operation.

In operation, when the longitudinal axis of the CV-joint assembly 307 needs to be altered, the solenoid valves 314 may be opened, causing drilling fluid to enter the turbine 312 and the turbine 312 to rotate. In certain embodiments, the speed of the turbine 312 may be controlled by partially opening or closing the solenoid valves 314. Torque from the turbine 312 may be imparted to the biasing mechanism 319 through the gearbox 318 at a sufficient strength to overcome the locking force. The torque may then cause the biasing mechanism 319 to rotate. As the biasing mechanism 319 rotates, the longitudinal axis of the CV-joint assembly 307 may change due to the interaction between the eccentric inner bore 320 and the CV-joint assembly 307 described above. The biasing mechanism 319 may continue rotating until a desired longitudinal axis for the CV-joint assembly 307 is achieved, at which point the solenoid valves 314 may be closed. Once the valves 314 are closed, drilling fluid may be prevented from driving the turbine 312, causing the turbine 312 to stop rotating and the torque imparted to the biasing mechanism 319 through the gearbox 318 to fall below the locking force of the locking mechanism 323, at which point the locking mechanism 323 rotationally secures the biasing mechanism 319. When the longitudinal axis of the CV-joint assembly 307 needs to be altered again, the valves 314 can be reopened and the turbine 312 driven to rotate the biasing mechanism 319 until the new inclination is achieved.

In certain embodiments a control unit (not shown) may determine that an inclination of a drilling assembly needs to be altered, and may transmit control signals to the solenoid valves 314 to cause the biasing mechanism 319 to rotate and the longitudinal axis of the CV-joint assembly 307 to change. In certain embodiments, the control unit may contain a reference plane for a drilling operation and the orientation of the drill string relative to the reference plane. The control unit may then determine the offset between the longitudinal axis of the housing 302 and the longitudinal axis for the CV-joint assembly 307 required to achieve the desired inclination. In certain embodiments, the control unit may further include information regarding the eccentric inner bore 320 as it relates to the rotational orientation of the biasing mechanism 319 and the resulting longitudinal axis of the CV-joint assembly 307. The control unit may receive measurements from sensors located within the drive assembly 300, such as sensors 317, and the control unit may determine when the desired longitudinal axis for the CV-joint assembly 307 has been reached, or will be soon reached, at which point the control unit may generate control signals to the solenoid valves 314 to cause them to close and stop rotation of the biasing mechanism 319.

FIGS. 4A-B are diagrams of an example locking mechanism 400 for a downhole motor, according to aspects of the present disclosure. The locking mechanism 400 may comprises an annular structure 402 with a plurality of pins 404 there through. The pins 404 may secure a plurality of locking ratchets 406 within the annular structure 402. The locking ratchets 406 may be positioned on an interior surface of the annular structure 402. In certain embodiments, the locking ratchets 406 may include spring mechanisms that force at least one edge of the locking ratchets 406 into an inner bore of the annular structure 402. The locking ratchets 406 may twist, the spring mechanisms compress, and the edges retract from the inner bore of the cylindrical structure 402 if the locking ratchets 406 are contacted by a sufficient force. The total force required to cause the locking ratchets 406 to retract may be characterized the locking force of the locking mechanism 400.

In the embodiment shown, a biasing mechanism 450 is at least partially within the inner bore of the annular structure 402. The biasing mechanism 450 comprises an annular structure 452 with an eccentric inner bore 454. At least one profile 456 may be positioned on an exterior surface of the annular structure 452. The profile 456 may comprise grooves or raised surfaces that are engagable with the locking ratchets 406 of the locking mechanism 400. In particular, as the annular structure 452 rotates in a clockwise direction, the profiles 456 may contact the locking ratchets 406 can causes the edges of the locking ratchets 406 to retract if the torque applied to the annular structure 452 is greater than the locking force of the locking mechanism 400. Notably, if the annular structure 452 rotates in a counter-clockwise direction, the shape and orientation of the locking ratchets 406 may prevent the counter-clockwise torque from overcoming the locking force. Other orientations and configurations of the locking mechanisms are possible, as would be appreciated by one of ordinary skill in the art in view of this disclosure.

According to aspects of the present disclosure, an example downhole motor may include a first housing and a second housing coupled to the first housing at a movable joint. A turbine may be within the first housing in selective fluid communication with a bore of the first housing. A biasing mechanism may be coupled to the turbine and the movable joint. A turbine may be coupled to the biasing mechanism, and a valve may be positioned between a bore of the first housing and the turbine. In certain embodiments, the biasing may comprise a rotatable cam with an eccentric inner bore and a profile on an exterior surface. The movable joint may comprise a constant-velocity joint assembly with a shaft, and the shaft may be at least partially within the eccentric inner bore. In certain embodiments, a locking mechanism may be positioned at least partially around the rotatable cam, the locking mechanism comprising a locking ratchet engagable with the profile.

According to aspects of the present disclosure, an example method for drilling using a downhole motor includes rotating a drill bit in a borehole using a downhole motor with a first bend angle, and changing the first bend angle to a second bend angle while the downhole motor is within the borehole. The drill bit then may be rotated in the borehole using the downhole motor with the second bend angle. In certain embodiments, rotating the drill bit in the borehole using the downhole motor with the first bend angle may comprise rotating the drill bit with a drive shaft at least partially disposed within a first housing of the downhole motor, the first bend angle comprising a first angle between a first longitudinal axis of the first housing and a second longitudinal axis of a second housing of the downhole motor. Changing the first bend angle to the second bend angle may comprise altering a position of a movable joint that couples the second housing to the first housing, the second bend angle comprising a second angle between the first longitudinal axis and the second longitudinal axis.

In certain embodiments, altering the position of the movable joint comprises rotating a biasing mechanism coupled to the movable joint. In certain embodiments, altering the position of the movable joint comprises exposing a turbine coupled to the biasing mechanism to a flow of drilling fluid through the downhole motor. The biasing mechanism may comprise a cam with an eccentric inner bore, and the movable joint may comprise a constant-velocity joint assembly with a shaft that is at least partially within the eccentric inner bore. The method may further include selectively locking the downhole motor to maintain the second bend angle.

According to aspects of the present disclosure, an example downhole motor may include a first housing and a constant-velocity (CV) joint assembly at least partially within the first housing. A second housing may be coupled to the CV joint assembly, and a fluid-driven rotor may be coupled to a drive shaft, the drive shaft at least partially within the first housing. The motor may include a rotatable cam with an eccentric inner bore within the first housing, a shaft of the CV joint assembly being at least partially within the eccentric inner bore. A turbine may be coupled to the rotatable cam, and a valve may provide selective fluid communication between a bore of the first housing and the turbine. In certain embodiments, the rotatable cam may comprise at least one profile on an outer surface, and a locking mechanism may be positioned at least partially around the rotatable cam. The locking mechanism may comprise a locking ratchet engagable with the profile.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee. The indefinite articles "a" or "an," as used in the claims, are defined herein to mean one or more than one of the element that it introduces.

What is claimed is:

1. A downhole motor, comprising:

a first housing;

a second housing coupled to the first housing at a movable joint;

a turbine within the first housing in selective fluid communication with a bore of the first housing;

a biasing mechanism coupled to the turbine and to the movable joint, wherein the biasing mechanism comprises a rotatable cam with an eccentric inner bore and a profile on an exterior surface of the rotatable cam; and a locking mechanism positioned at least partially around the rotatable cam, wherein the locking mechanism comprises a locking ratchet engagable with the profile.

2. The downhole motor of claim 1, further comprising a bit shaft at least partially within the second housing.

3. The downhole motor of claim 2, further comprising a fluid-driven rotor coupled to a drive shaft, the drive shaft at least partially within the first housing and coupled to the bit shaft.

4. The downhole motor of claim 3, further comprising a valve positioned between a bore of the first housing and the turbine.

5. The downhole motor of claim 1, wherein the movable joint comprises a constant-velocity joint assembly with a shaft; and the shaft is at least partially within the eccentric inner bore.

6. A method for drilling using a downhole motor, comprising:

rotating a drill bit in a borehole using a downhole motor with a first bend angle, wherein the first bend angle comprises a first angle between a first longitudinal axis of a first housing and a second longitudinal axis of a second housing of the downhole motor;

changing the first bend angle to a second bend angle while the downhole motor is within the borehole by rotating a biasing mechanism coupled to a movable joint, wherein the biasing mechanism comprises a rotatable cam with an eccentric inner bore and a profile on an exterior surface of the rotatable cam;

the movable joint couples the second housing to the first housing; and rotating the biasing mechanism comprises exposing a turbine coupled to the biasing mechanism to a flow of drilling fluid through the downhole motor;

rotating the drill bit in the borehole using the downhole motor with the second bend angler; and selectively locking a locking mechanism positioned at least partially around the rotatable cam by engaging a locking ratchet of the locking mechanism with the profile.

7. The method of claim 6, wherein rotating the drill bit in the borehole using the downhole motor with the first bend angle comprises rotating the drill bit with a drive shaft at least partially disposed within a first housing of the downhole motor.

8. The method of claim 7, wherein the second bend angle comprises a second angle between the first longitudinal axis and the second longitudinal axis.

9. The method of claim 6, wherein the movable joint comprises a constant-velocity joint assembly with a shaft that is at least partially within the eccentric inner bore.

10. The method of claim 6, further comprising selectively locking the downhole motor to maintain the second bend angle.

11. A downhole motor, comprising:

a first housing;

a constant-velocity (CV) joint assembly at least partially within the first housing;

a second housing coupled to the CV joint assembly;

a fluid-driven rotor coupled to a drive shaft, the drive shaft at least partially within the first housing; and a rotatable cam with an eccentric inner bore within the first housing, a shaft of the CV joint assembly at least partially within the eccentric inner bore;

a turbine coupled to the rotatable cam; and a valve that provides selective fluid communication between a bore of the first housing and the turbine.

12. The downhole motor of claim 11, wherein the rotatable cam comprises at least one profile on an outer surface.

13. The downhole motor of claim 12, further comprising a locking mechanism positioned at least partially around the rotatable cam.

14. The downhole motor of claim 13, wherein the locking mechanism comprises a locking ratchet engagable with the profile.

* * * * *